US006854399B2

(12) United States Patent
Inage

(10) Patent No.: US 6,854,399 B2
(45) Date of Patent: Feb. 15, 2005

(54) SIDE SLIDING DOOR APPARATUS FOR ELECTRIC RAILCAR

(75) Inventor: Akio Inage, Mie (JP)

(73) Assignee: Fuji Electric Co., Ltd., Kawasaki (JP)

( * ) Notice: Subject to any disclaimer, the term of this patent is extended or adjusted under 35 U.S.C. 154(b) by 105 days.

(21) Appl. No.: 10/310,174

(22) Filed: Dec. 5, 2002

(65) Prior Publication Data

US 2003/0106457 A1 Jun. 12, 2003

(30) Foreign Application Priority Data

Dec. 12, 2001 (JP) ..... 2001-378050
Oct. 23, 2002 (JP) ..... 2002-308133

(51) Int. Cl.[7] ..... B61D 1/00
(52) U.S. Cl. ..... 105/341; 49/116; 292/49
(58) Field of Search ..... 49/118, 116, 117, 49/141, 280, 291, 293, 300, 322, 360, 449; 105/119, 332, 339, 340, 341, 348, 349; 292/49, 254, 216, 26, 48, DIG. 46, 32, 137, 163, 169.11, DIG. 21

(56) References Cited

U.S. PATENT DOCUMENTS 1,976,223 A 10/1934 Hedley et al.
3,802,123 A * 4/1974 Frey et al. ..... 49/141
3,961,447 A * 6/1976 Wolz ..... 49/362
4,094,533 A * 6/1978 Grossbach ..... 280/803
5,341,598 A * 8/1994 Reddy ..... 49/362
5,722,272 A * 3/1998 Bridgeman et al. ..... 70/264
5,755,060 A 5/1998 Zweili
5,927,015 A 7/1999 Ghosn et al.
6,009,668 A 1/2000 Reddy
6,032,416 A * 3/2000 Springer et al. ..... 49/119
6,446,389 B1 9/2002 Heffner et al.

FOREIGN PATENT DOCUMENTS

EP 0 846 830 6/1998
JP 2000-142392 5/2000

* cited by examiner

*Primary Examiner*—Frantz F. Jules
(74) *Attorney, Agent, or Firm*—Manabu Kanesaka

(57) ABSTRACT

A side sliding door apparatus for an electric railcar includes two sliding doors movably supported by a horizontal door rail to open and close an entrance of the electric railcar. The side sliding door apparatus includes an actuator for actuating the sliding door, a locking mechanism for locking the sliding door in a closed state, and an unlocking mechanism for unlocking the sliding door locked by the locking mechanism. The actuator, the locking mechanism, and the unlocking mechanism are provided in each of the two sliding doors. The right and left actuators operate independently from each other, and thus, even if the actuator for one sliding door breaks down, the other sliding door still can be used.

16 Claims, 6 Drawing Sheets

SIDE SLIDING DOOR APPARATUS FOR ELECTRIC RAILCAR

BACKGROUND OF THE INVENTION AND RELATED ART STATEMENT

The present invention relates to a side sliding door apparatus having right and left sliding doors for opening and closing a side entrance of a railcar.

For protecting passengers in a railcar, a side sliding door apparatus is required to have a high operational reliability without any accidental operation while the railcar is running or staying stationary. To satisfy this requirement, the inventors of the present invention have developed a side sliding door apparatus for an electric railcar disclosed in Japanese Patent Publication (KOKAI) No. 2000-142392. According to the publication, the side sliding door apparatus is provided with one actuator for two sliding doors, and the actuator opens/closes and locks/unlocks the sliding doors.

FIG. 9 to FIG. 12 show the side sliding door apparatus for the electric railcar disclosed in the patent publication, and a brief description thereof will be given. FIG. 9 is a side view showing an entire structure of the side sliding door apparatus for the electric railcar, and FIG. 10 is an enlarged view showing essential parts thereof. In FIGS. 9 and 10, two sliding doors 1 and 2 are movably suspended from a door rail 3, which is mounted horizontally along a side of the electric railcar via moving bodies 4. The sliding doors 1 and 2 are capable of moving horizontally in reverse directions to open and close an entrance of the electric railcar. The sliding door 1 at the left side in FIG. 9 is driven by a linear motor 5 as an actuator connected to the moving body 4 of the sliding door 1. As shown in FIG. 10, a movable element 5*a* of the linear motor 5 is connected to the moving body 4 such that the movable element 5*a* can slide by a predetermined distance x in opening and closing directions (in the horizontal direction in FIG. 10). A compression spring 6 is interposed between the movable element 5*a* and the moving body 4. With this arrangement, the movable element 5*a* can freely move relative to the sliding door 1 by the predetermined distance x in the opening direction of the sliding door 1.

On the other hand, the sliding door 2 at the right side is moved along with a motion of the sliding door 1 via a direction changing mechanism 7. As shown in FIG. 10, the direction changing mechanism 7 is comprised of a lower rack 9 connected to the moving body 4 of the sliding door 1 via a connecting rod 8, an upper rack 11 connected to the moving body 4 of the sliding door 2 via a connecting plate 10, and a pinion 12 engaging the racks 9 and 11 at the same time. The lower rack 9 and the upper rack 11 are guided in a unit case 7*a* fixed on the railcar side such that they can slide in the opening and closing directions. A shaft fixed on the unit case 7*a* supports the pinion 12. The direction changing mechanism 7 changes a moving direction of the sliding door 1 driven by the linear motor 6 and transmits the motion to the sliding door 2.

FIGS. 11 and 12 show details of a locking mechanism 13 arranged at a side of the direction changing mechanism 7 (in FIG. 9), as well as a push rod 14 and a pull fitting 15 for causing the locking mechanism 13 to lock and unlock the sliding doors 1, 2. FIG. 11 shows a state in which the locking mechanism 13 locks the sliding doors 1, 2. FIG. 12 shows a state in which the locking mechanism 13 unlocks the sliding doors 1, 2. In FIGS. 11 and 12, the push rod 14 and the pull fitting 15 are mounted on the movable element 5*a* of the linear motor 5. The push rod 14 is fixed horizontally, and the pull fitting 15 with a hook end is placed over an upper surface of the push rod 14 and is connected to the push rod 14 to rotate vertically by a pin at one end. The pull fitting 15 is forced upward by a compression spring 16 interposed between the pull fitting 15 and the push rod 14, and is restricted in an upward rotational range by a headed pin 17 that loosely penetrates the push rod 14 to be screwed into the pull fitting 15. A guide fitting 18, which is arranged to contact an upper surface of the pull fitting 15 to limit the pull fitting 15 from rotating upward, is fixed at a front end of a frame of the linear motor 5.

The locking mechanism 13 is comprised of a vertical latch rod 22 guided in a guide cylinder 21 supported and fixed by the unit case 7*a* to slide in an axial direction, a latch plate 23 integrated with a head of the latch rod 22, and a lock spring 24 comprised of a tension spring for urging the latch rod 22 downward. For moving the locking mechanism 13 with the sliding door 1, the locking mechanism 13 is comprised of a slider 19 guided to slide in a moving direction of the sliding doors 1, 2, and a back spring 20 comprised of a compression spring for urging the slider 19 toward the sliding door 2. A cam surface 19*a* comprised of an inclined step is formed at an upper side of the slider 19. An engagement protrusion 19*b* is provided at an end of the slider 19. A roller 25 contacting the cam surface 19*a* of the slider 19 is rotatably mounted on the latch rod 22 via an attachment fitting (not shown). The lock spring 24 is extended between the latch plate 23 and the unit case 7*a* for urging the latch rod 22 downward. As described later, the latch rod 22 moves up and down in response to the opening and closing motions of the sliding doors 1, 2.

FIG. 11 shows a state in which the sliding doors 1, 2 are locked in a closed state in the above described side sliding door apparatus. In this state, an end of the latch rod 22 is inserted into the latch hole 26 of the upper rack 11 constituting an engagement section of the direction changing mechanism 7 to lock the sliding motion of the upper rack 11. Thus, the sliding doors 1, 2 connected to the upper rack 11 can not move.

Further, in this state, the push rod 14 is brought into contact with the engagement protrusion 19*b* of the slider 19, and the hook portion of the pull fitting 15 is engaged with the head of the engagement protrusion 19*b* with an inclined surface. When an opening instruction is given in this state, the movable element 5*a* of the linear motor 5 moves leftward. At an initial stage of this movement, the movable element 5*a* moves leftward by a predetermined distance x with compressing the compression spring 6 while leaving the sliding door 1 in a closed position. In the meantime, the pull fitting 15 pulls the slider 19 via the engagement protrusion 19*b*. At this moment, the pull fitting 15 tries to rotate upward due to the urging force of the compression spring 16 and the action of the inclined surface of the head of the engagement protrusion 19*b*, but can not rotate because the guide fitting 18 presses the pull fitting 15.

When the slider 19 is pulled leftward, the roller 25 is pushed up onto the upper surface of the slider 19 via the inclined plane of the cam surface 19*a*. This causes the latch rod 22 to be lifted and pulled out the latch hole 26 to release from the upper rack 11, thereby unlocking the sliding doors 1, 2. When the movable element 5*a* moves for almost the predetermined distance x, the pull fitting 15 is released from the guide fitting 18. As a result, the pull fitting 15 is rotated upward by the urging force of the compressing spring 16 and is released from the engagement protrusion 19*b* of the slider 19. Even when the pull fitting 15 is released, the slider 19 remains in an advancement position due to the urging force of the back spring 20 and keeps the roller 25 pushed up.

Then, the movable element 5*a* moves the sliding door 1 leftward up to a predetermined full-open position. Accordingly, the sliding door 2 moving along the sliding door 1 via the direction changing mechanism 7 moves rightward, so that the sliding doors 1, 2 are opened. The sliding door 1 then moves rightward in response to a closing instruction, and when the sliding door 1 reaches the closing position in FIG. 11, the movable element 5*a* pushes the slider 19 via the push rod 14. Consequently, the roller 25 falls off the upper side of the cam surface 19*a*, and the latch rod 22 gets into the latch hole 26 of the upper lack 11 to lock the sliding doors 1, 2. At the same time, the guide fitting 18 pushes the pull fitting 15 to engage the engagement protrusion 19*b*. Incidentally, to open the sliding doors 1, 2 in a case of emergency, a handle 27 in FIG. 9 is rotated 90° to pull up the latch rod 22 via a cable wire 28 to forcibly unlock the sliding doors 1, 2.

In was found that the above described side sliding door apparatus for the electric railcar disclosed in Japanese Patent Publication No. 2000-142392 has problems as described below.

The right and left sliding doors are connected to each other via the direction changing mechanism, and one actuator drives the two sliding doors. For this reason, when the actuator breaks down, the two sliding doors can not open and close, making it impossible to use the entrance.

When the sliding doors are opened, the actuator is slightly moved in the opening direction to unlock the sliding doors. For this reason, if the actuator accidentally moves in the opening direction even slightly while the electric railcar is running, there is a possibility that the sliding doors may be opened.

It is therefore an object of the present invention to improve the safety in a case where the actuator for the sliding doors breaks down or has a failure.

Further objects and advantages of the invention will be apparent from the following disclosure of the invention.

SUMMARY OF THE INVENTION

To attain the above object, the present invention provides a side sliding door apparatus for an electric railcar, which comprises two sliding doors movably supported by a horizontal door rail to open and close an entrance at a side of the electric railcar. The side sliding door apparatus includes an actuator for actuating the sliding doors, a locking mechanism for locking the sliding doors in a closed state, and an unlocking mechanism for unlocking the sliding doors locked by the locking mechanism. The actuator, the locking mechanism, and the unlocking mechanism are provided in the respective two sliding doors. The right and left actuators operate independently with each other, and thus, even if the actuator for one sliding door breaks down, the other sliding door still can be used. It is preferred that a linear motor is used as the actuator.

The locking mechanism may move mechanically in response to a closing action of the sliding doors to lock the sliding doors. With this arrangement, the sliding doors are locked whenever they are closed. In a case where another drive means drives the locking mechanism, it is still possible to lock the sliding doors even though the drive means is broken.

It is preferred that drive means independent of the actuator drives the locking mechanism to lock the sliding doors. With this arrangement, even if the actuator breaks down, the unlocking action is not affected by the breakdown, and at least the sliding doors can be opened manually.

It is also preferred that the locking mechanism is comprised of a latch member movably supported on a railcar side and engaging a fixing member on a sliding door side for locking the sliding doors in the closed state, and a forcing member for urging the latch member toward the sliding doors.

The latch member is preferably comprised of a latch rod supported to slide on the railcar side and to be inserted into a latch hole formed in the fixing member on the sliding door side to lock the sliding doors in the closed state. The forcing member is comprised of a spring that urges the latch rod against the latch hole.

It is preferred that the unlocking mechanism is comprised of drive means for driving the latch member against the forcing member to release the latch member from the fixing member. In this case, an electromagnetic solenoid is preferably used as the drive means.

Release-holding means may be provided for holding the latch member released from the sliding doors. With this arrangement, the drive means for the unlocking mechanism can be turned off in the state that the sliding doors are opened. The sliding doors can be kept unlocked with a higher reliability than a case where the drive means for the unlocking mechanism is kept on.

The release-holding means may be comprised of a locking member for locking the latch member released from the sliding door, moving means for moving the locking member in response to an opening action of the sliding doors to a locked position where the latch member is locked, and returning means for returning the latch member from the locked position in response to a closing action of the sliding doors to a wait position where the latch member is unlocked.

The locking member may be comprised of a slider supported to slide on the railcar side and inhibits the latch member from moving toward the sliding door via a cam part. Also, the moving means may be comprised of a spring interposed between the slider and the railcar side.

It is possible that the moving means is comprised of a torsion member that slides the slider by a predetermined distance in response to the movement of the sliding doors when the sliding doors are opened.

It is preferred that the returning means is comprised of a pushing member that slides the slider by the predetermined distance in a direction opposite to a direction, in which the slider is slid when the sliding doors are opened, in response to the movement of the sliding doors when the sliding doors are closed. Therefore, it is possible to securely unlock the latch member mechanically in response to the closing movement of the sliding doors.

In addition, lock-detecting means may be provided for determining whether the sliding doors are locked. This lock-detecting means is used to detect whether the sliding doors are locked or not, and if they are not locked, the electric railcar is inhibited from starting.

Further, it is preferred that door closure detecting means is provided for determining whether the sliding doors are opened or closed. A closing signal transmitted from the door closure detecting means as well as a locking signal are necessary for starting the electric railcar, and an opening signal transmitted from the door closure detecting means causes the drive means for the unlocking mechanism to be turned off.

DETAILED DESCRIPTION OF PREFERRED EMBODIMENTS

Figure 1:
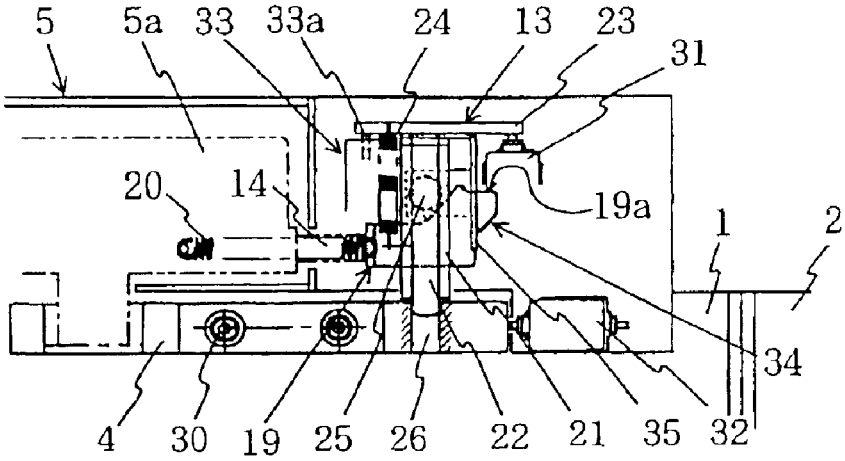
FIG. 1 is a side view showing a locked state of a side sliding door apparatus according to an embodiment of the present invention.

Hereunder, embodiments of the present invention will be explained with reference to the accompanying drawings. FIGS. 1 to 4 show an embodiment of the present invention. Elements and parts corresponding to those of the prior art shown in FIGS. 9 to 12 are denoted by the same reference numerals.

FIG. 1 is a side view showing essential parts of a side sliding door apparatus in a locked state. In FIG. 1, two sliding doors 1, 2 are suspended from a door rail (not shown) that is mounted horizontally along a side of an electric railcar. The sliding doors move via moving bodies 4 horizontally in reverse directions in FIG. 1 to open and close an entrance of the electric railcar. Each of the two sliding doors 1, 2 is independently provided with a linear motor 5 as an actuator for opening and closing the sliding door 1 or 2, a locking mechanism for locking the sliding door 1 or 2 in a closed state, and an unlocking mechanism for unlocking the sliding door 1 or 2. In FIG. 1, the linear motor 5 and the other components are shown only in the left sliding door 1. Therefore, even if the linear motor 5 for one of the two sliding doors 1, 2 breaks down, the other of the two sliding doors 1, 2 can be opened and closed by the linear motor 5. The sliding door 1 will be explained next, but the structures and operations of the sliding door 1 are the same as those of the sliding door 2.

In FIG. 1, the moving body 4 is fixed to the sliding door 1 by two bolts 30, and a movable element 5*a* of the linear motor 5 is connected to the moving body 4. In the closed state shown in FIG. 1, the sliding door 1 is locked by a locking mechanism 13. The locking mechanism 13 is comprised of a latch rod 22 as a latch member supported on the railcar side to slide in the vertical direction, and a lock spring 24 comprised of a tension coil spring as a forcing member for urging the latch rod 22 toward the sliding door 1. The latch rod 22 is comprised of a circular rod, and is guided into a hollow square guide cylinder 21 to enter/exit a latch hole 26 formed in the moving body 4 as a fixing member on the sliding door side. A latch plate 23 is secured to a head of the latch rod 22, and the lock spring 24 extends between the latch plate 23 and the guide cylinder 21 in a pressed state. The latch rod 22 inserted into the latch hole 26 engages the moving body 4 to lock the sliding door 1 in the closed state.

A reference numeral 31 denotes a lock switch (a limit switch) as lock-detecting means, which is fixed on the railcar and is turned on in the locked state to transmit a locking signal to the railcar. A reference numeral 32 denotes a door-closing switch as door closure detecting means, which is turned on in the closed state to transmit a closing signal to the railcar. An electromagnetic solenoid 33 is provided as an unlocking mechanism for driving the latch rod 22 against the force of the lock spring 24. The electromagnetic solenoid 33 is fixed vertically on the railcar side. When the electromagnetic solenoid 33 turns off, a plunger 33*a* is positioned in the vicinity of a lower surface of the latch plate 23.

In FIG. 1, release-holding means 34 is provided to hold the latch rod 22 in a released state from the moving body 4. The release-holding means 34 is comprised of a slider 19 as locking means for locking the latch rod 22 released from the moving body 4, and a back spring 20 comprised of a tension coil spring as moving means for moving the slider 19 to a lock position where the latch rod 22 is locked. The slider 19 is supported on the railcar side to slide horizontally in FIG. 1, and contacts a roller 25 integrated with the latch rod 22 via a cam surface 19*a* to prevent the latch rod 22 from moving into the latch hole 26. The roller 25 is rotatably mounted on a mounting plate 35 integrated with the head of the latch head 22. The back spring 20 has one end hooked on the slider 19 and the other end hooked on the railcar side. Therefore, in the closed state shown in FIG. 1, the slider 19 is pushed rightward in FIG. 1 by a push rod 14 as a pushing member mounted at an end of the movable element 5*a*, and the cam surface 19*a* is released from the roller 25 and the back spring 20 is extended.

Figure 2:
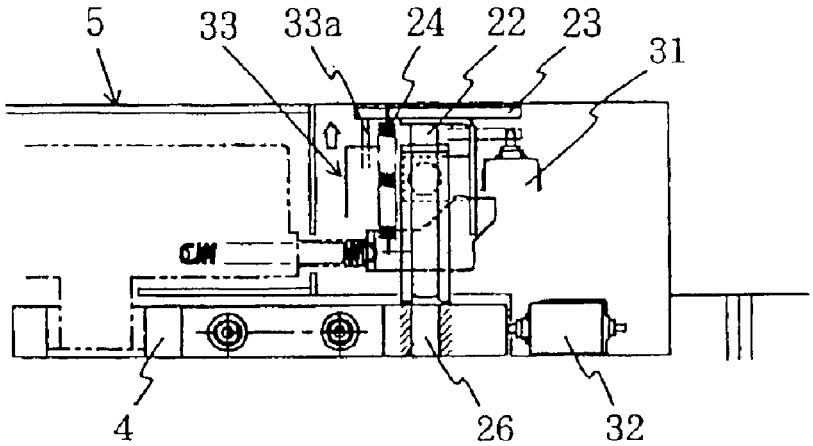
FIG. 2 is a side view showing an unlocking action of the side sliding door apparatus shown in FIG. 1.

FIG. 2 shows an unlocking action. When an opening instruction is sent in the closed state shown in FIG. 1, the electromagnetic solenoid 33 is turned on and the plunger 33*a* is pulled to protrude upward. The plunger 33*a* lifts the latch rod 22 via the latch plate 23 to release the latch rod 22 from the latch hole 26. The latch rod 22 is released from the moving body 4 to unlock the sliding door 1. At this moment, the lock switch 33 is turned off to transmit an unlocking signal to the railcar side. The unlock spring 24 is extended to generate a force for urging the latch rod 22 downward. In FIG. 2, the sliding door 1 is unlocked by the electromagnetic solenoid 33 as drive means different from the linear motor 5. Therefore, the sliding door 1 is prevented from being accidentally unlocked due to a failure or a breakdown of the linear motor 5.

Figure 3:
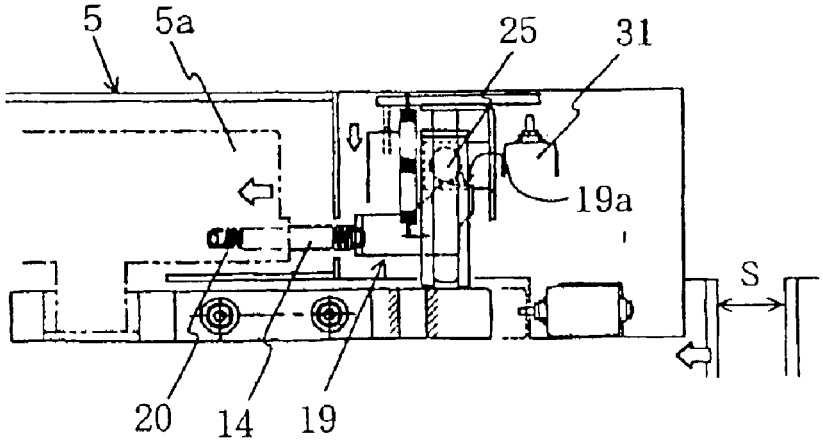
FIG. 3 is a side view showing an opening action of the side sliding door apparatus shown in FIG. 1.

FIG. 3 is a view showing an opening action following the unlocking action. When an unlocking signal is transmitted from the lock switch 31, the linear motor 5 is turned on after a predetermined time, and the movable element 5*a* starts moving leftward in FIG. 2. At this moment, the door closure switch 32 is turned off to transmit an opening signal to the railcar side. FIG. 3 shows a state when a distance between the sliding doors 1 and 2 reaches a distance S as a result of the slight movement of the movable element 5*a*. Upon the movement of the movable element 5*a*, the slider 19 pressed by the push rod 14 moves from a standby position in FIG. 2 in the same direction as that of the movable element 5*a* due to an urging force of the back spring 20. As a result, the cam surface 19*a* reaches a position below the roller 25. Afterwards, the sliding door 1 is fully opened and stopped, and the cam surface 19*a* reaches a position just below the roller 25, i.e. a lock position where the latch rod 22 is locked in a released state from the moving body 4. In this state, the slider 19 abuts against a front surface of a housing of the linear motor 5 and stops (refer to FIG. 4).

After a predetermined time since the door closure switch 32 transmits the opening signal, the electromagnetic solenoid 33 is turned off. Accordingly, the latch rod 22 lifted by the plunger 33*a* tries to move downward by the urging force of the lock spring 24, but stops when the roller 25 is brought into contact with the cam surface 19*a*, and the sliding door 1 is kept unlocked. In FIG. 3, the sliding door 1 is kept unlocked mechanically, and the electromagnetic solenoid 33 is kept off. Thus, power consumption is reduced as compared with a case where the sliding door 1 is kept unlocked with the electromagnetic solenoid 33 being kept on, thereby achieving a high operational reliability.

Figure 4:
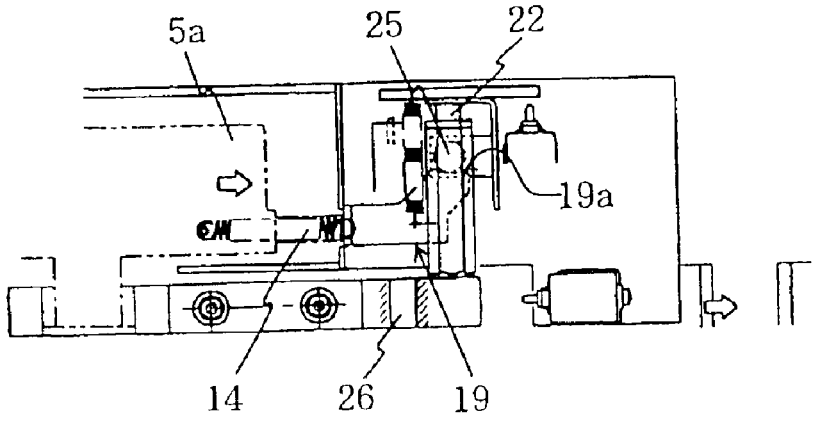
FIG. 4 is a side view showing a locking action of the side sliding door apparatus shown in FIG. 1.

FIG. 4 shows a locking action. When a closing instruction is sent in the state in which the sliding door 1 is opened, the movable element 5*a* moves rightward in FIG. 4 to bring the push rod 14 into contact with the slider 19. FIG. 4 shows the locking action when the push rod 14 reaches the slider 19. As the movable element 5*a* moves further, the push rod 14 presses the slider 19 rightward to release the cam surface 19*a* from the roller 25. This causes the latch rod 22 unsupported to move downward by the return force of the lock spring 24, so that the end thereof is brought into contact with the moving body 4. With the rightward movement of the moving body 4, the latch rod 22 falls into the latch hole 26 to lock the sliding door 1 while sliding on the upper surface of the moving body 4. As a result, the side sliding door is locked again as shown in FIG. 1. In the meantime, the back spring (FIG. 1) is extended to restore the urging force for the next sliding door opening action.

FIGS. 5 to 8 show a side sliding door apparatus according to another embodiment of the present invention. In the locked state of the side sliding door apparatus shown in FIG. 5, a difference from the first embodiment is that a pull fitting 40 as a pulling member is provided instead of the back spring 20 shown in FIG. 1. The pull fitting 40 functions as the moving means for sliding the slider 19 to the locked position where the latch rod 22 is locked in a state released from the sliding door 1 when the sliding door 1 is opened.

In the first embodiment, the back spring 20 is stretched when the sliding door 1 is closed as shown in FIG. 4. The slider 19 is advanced to the locked position by the force of the back spring when the sliding door 1 is opened as shown in FIG. 3. Thus, to close the sliding doors 1, the linear motor 5 needs to generate a force and a speed in addition to the resistance of the back spring 20, thereby requiring to increase a capacity of the linear motor 5. As a result, a large collision noise between the latch rod 22 and the moving body 4 is created when the latch rod 22 falls into the latch hole 26 upon locking the latch rod. When the latch rod 22 is unlocked, a large suction force must be applied to the electromagnetic solenoid 33 to overcome an increase in the frictional force generated between the latch rod 22 and the latch hole 26 due to a reactive force of the back spring 20 applied to the moving body 4 via the push rod 14. For this reason, the back spring 20 is eliminated in the second embodiment as shown in FIG. 5.

Figure 5:
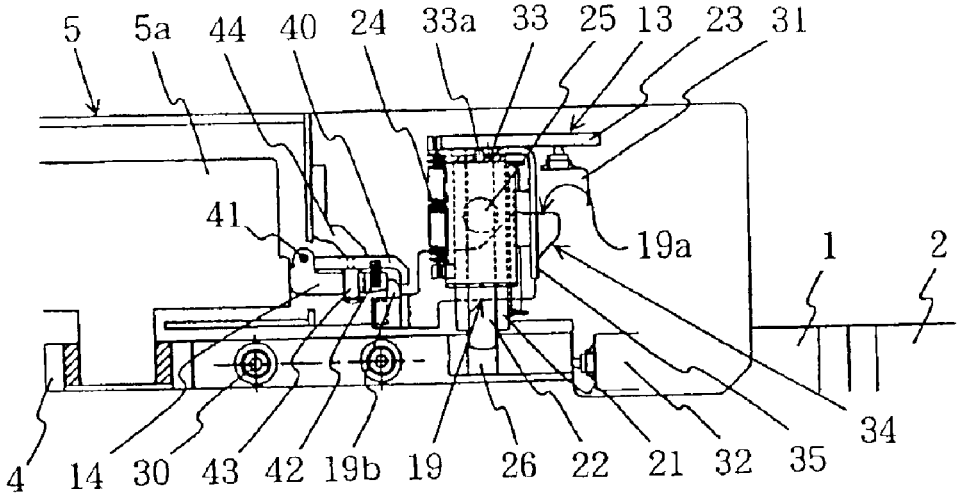
FIG. 5 is a side view showing a locked state of a side sliding door apparatus according to another embodiment of the present invention.

Specifically, as shown in FIG. 5, the pull fitting 40 is mounted on the movable element 5*a* of the linear motor in addition to the push rod 14 as mentioned above. The pull fitting 40 with a hook end is placed over an upper surface of the push rod 14 fixed horizontally, and is joined via a pin 41 at one end to rotate vertically. The pull fitting 40 is forced upward by a compression spring 42 interposed between the pull fitting 40 and the push rod 14, and is restricted in an upward rotation by a headed pin 43 that loosely penetrates the push rod 14 to be screwed into the pull fitting 40. A guide fitting 44 is fixed at the front end of the frame of the linear motor 5 such that the guide fitting 44 contacts an upper surface of the pull fitting 40 to restrict the upward rotation thereof. The slider 19 is provided with the engagement protrusion 19*b* engaging the pull fitting 40. In the state in which the latch rod 22 is locked (i.e. the sliding doors are closed) as shown in FIG. 5, the push rod 14 abuts against the engagement protrusion 19*b* of the slider 19, and the hook portion of the pull fitting 40 engages a head of the engagement protrusion 19*b* with an inclined surface. Except for the above-described difference, the arrangement of the side sliding door apparatus according to the second embodiment is substantially identical with that of the side sliding door apparatus according to the first embodiment.

Figure 6:
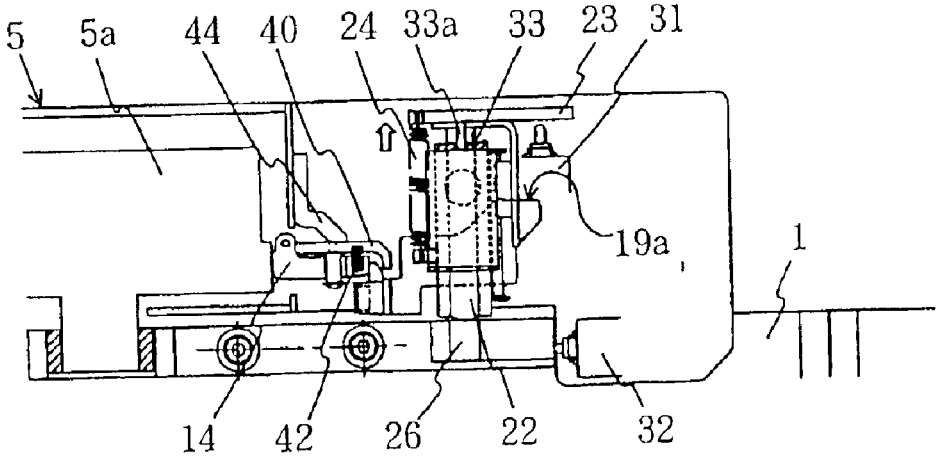
FIG. 6 is a side view showing an unlocking action of the side sliding door apparatus shown in FIG. 5.

FIG. 6 shows an unlocking action. When an opening instruction is sent in the closed state shown in FIG. 5, the electromagnetic solenoid 33 is turned on and the plunger 33*a* is pulled to protrude upward. The plunger 33*a* lifts the latch rod 22 via the latch plate 23 to cause the latch rod 22 to exit the latch hole 26. This releases the latch rod 22 from the moving body 4 to unlock the sliding door 1. On this occasion, the lock switch 33 is turned off to transmit the unlocking signal to the railcar side. The unlock spring 24 is stretched to generate a force for urging the latch rod 22 downward. The unlocking action described so far is identical with that of the first embodiment.

Figure 7:
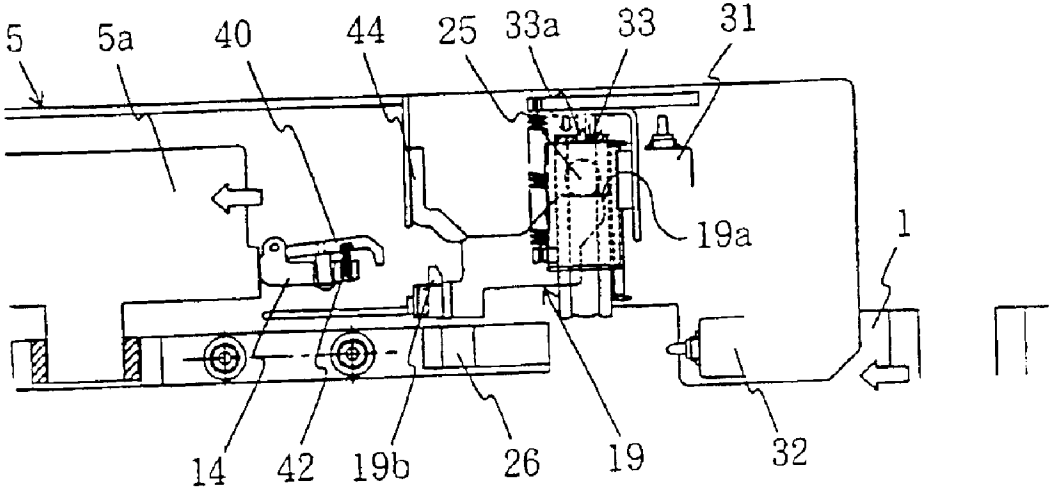
FIG. 7 is a side view showing an opening action of the side sliding door apparatus shown in FIG. 5.

FIG. 7 shows an opening action following the unlocking action. In response to the unlocking signal transmitted from the lock switch 31, the linear motor 5 is turned on after a predetermined time, and the movable element 5*a* starts moving leftward in FIG. 6. On this occasion, the door closure switch 32 is turned off to transmit the opening signal to the railcar side. Upon the leftward movement of the movable element 5*a*, the pull fitting 40 pulls the slider 19 via the engagement protrusion 19*b*. On this occasion, the torsion spring 40 tries to rotate upward due to the urging force of the compression spring 42 and the action of the inclined surface of the head of the engagement protrusion 19*b*, but can not rotate because it is pressed by the guide fitting 44. The cam surface 19*a* of the slider 19 pulled by the pull fitting 40 reaches a position below the roller 25. When the movable element 5*a* moves for a predetermined distance, the guide fitting 44 is released from the pull fitting 40. As a result, the pull fitting 40 rotates upward to be released from the engagement protrusion 19*b* of the slider 19. On this occasion, the cam surface 19*a* reaches a position just below the roller 25, and the slider 19 is brought into contact with the front surface of the housing for the linear motor 5 and then stops. Afterwards, the sliding door 1 fully opens and stops.

After a predetermined time since the door closure switch 32 transmits the opening signal, the electromagnetic solenoid 33 is turned off. Accordingly, the latch rod 22 lifted by the plunger 33*a* tries to move downward by the urging force of the lock spring 24, but stops when the roller 25 is brought into contact with the cam surface 19*a*, thus keeping the latch rod 22 unlocked.

Figure 8:
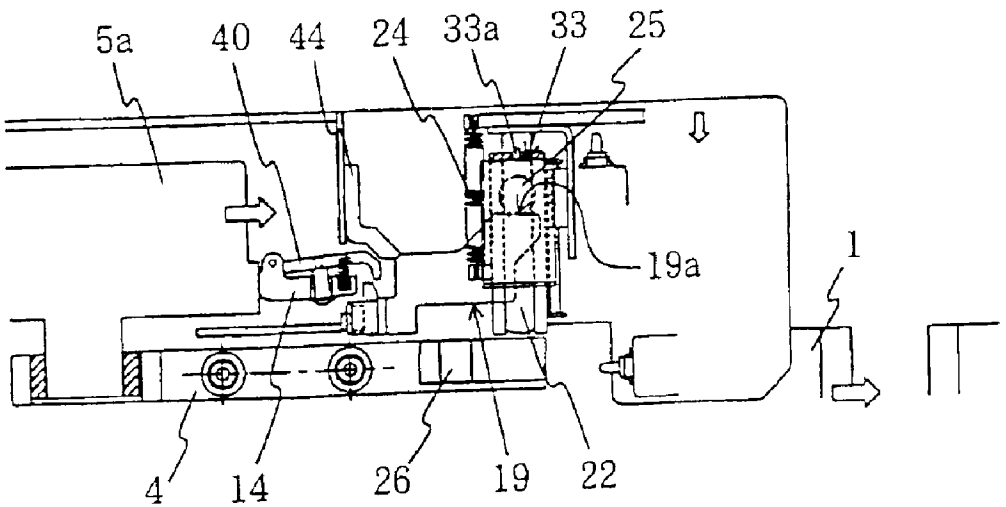
FIG. 8 is a side view showing a locking action of the side sliding door apparatus shown in FIG. 5.
Figure 9:
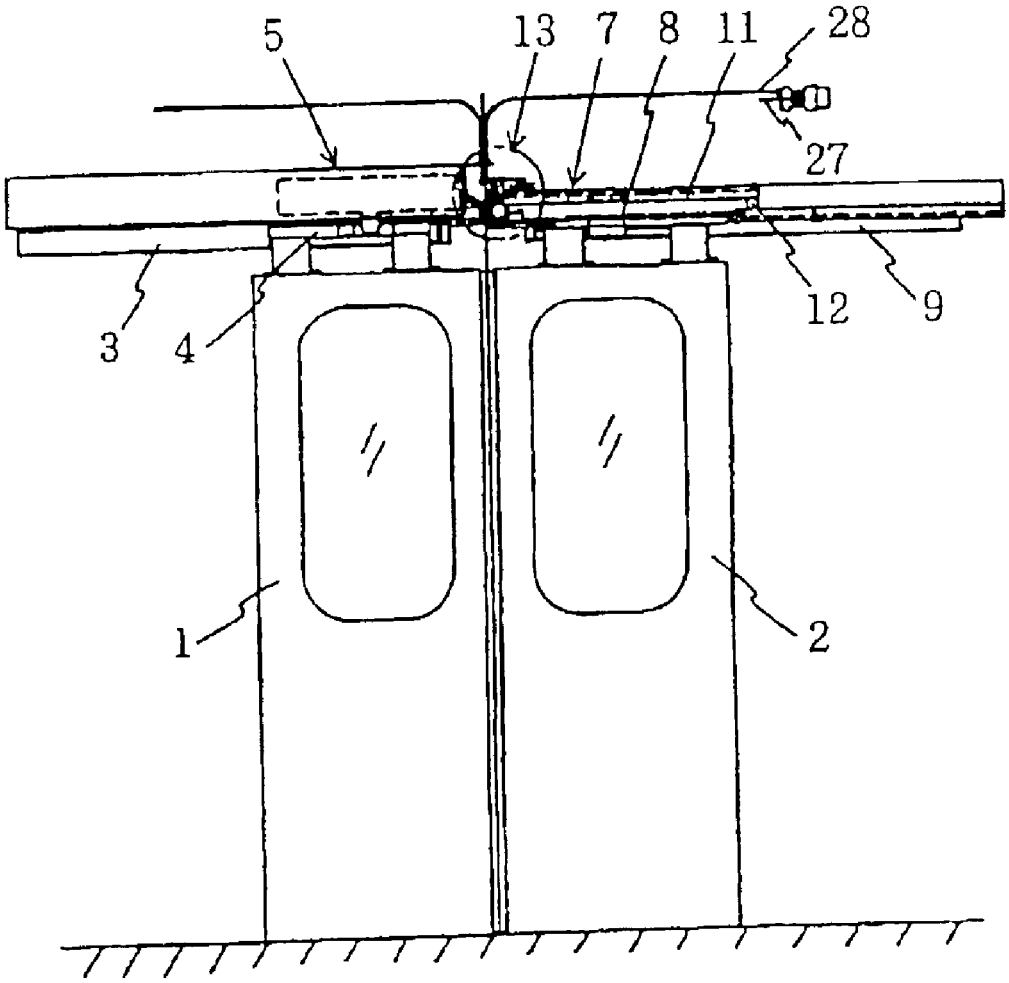
Fig. 9 Prior Art
FIG. 9 is a side view showing an entire structure of a conventional side sliding door apparatus.
Figure 10:
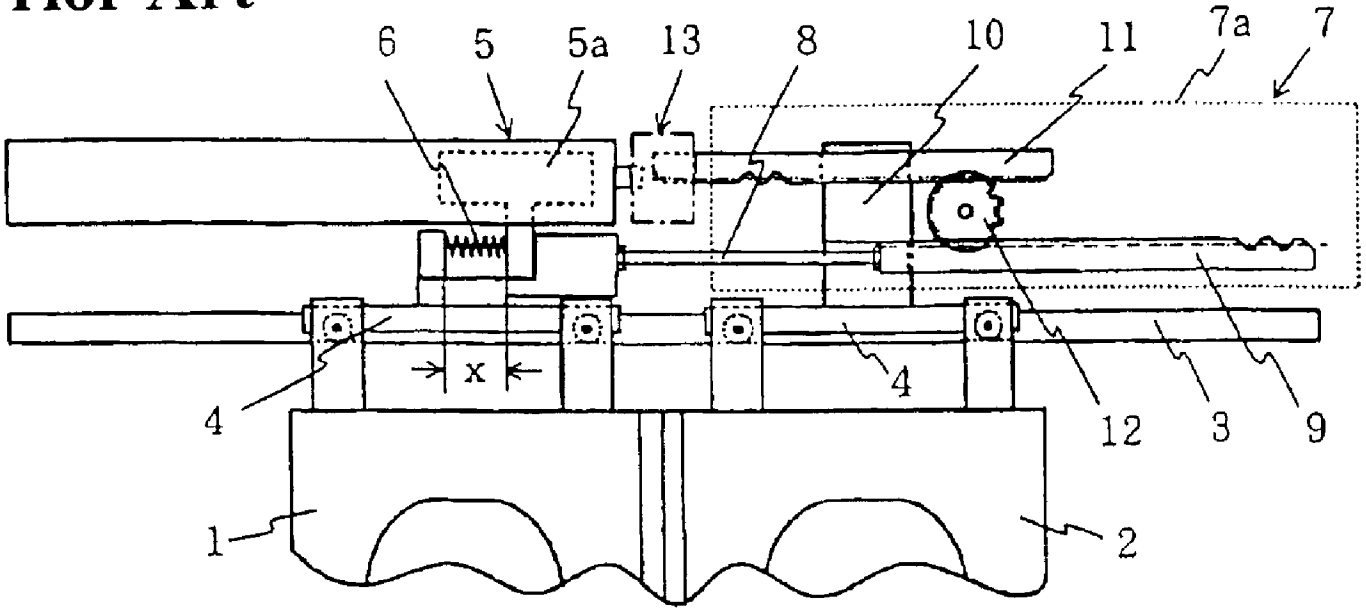
Fig. 10 Prior Art
FIG. 10 is an enlarged view showing essential parts of the side sliding door apparatus shown in FIG. 9.
Figure 11:
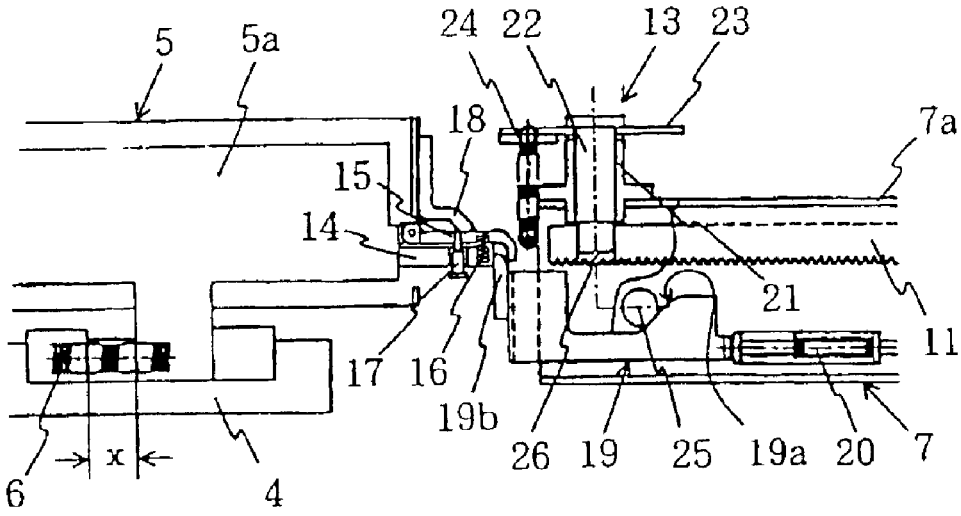
Fig. 11 Prior Art
FIG. 11 is a side view showing a locked state of the side sliding door apparatus shown in FIG. 9.
Figure 12:
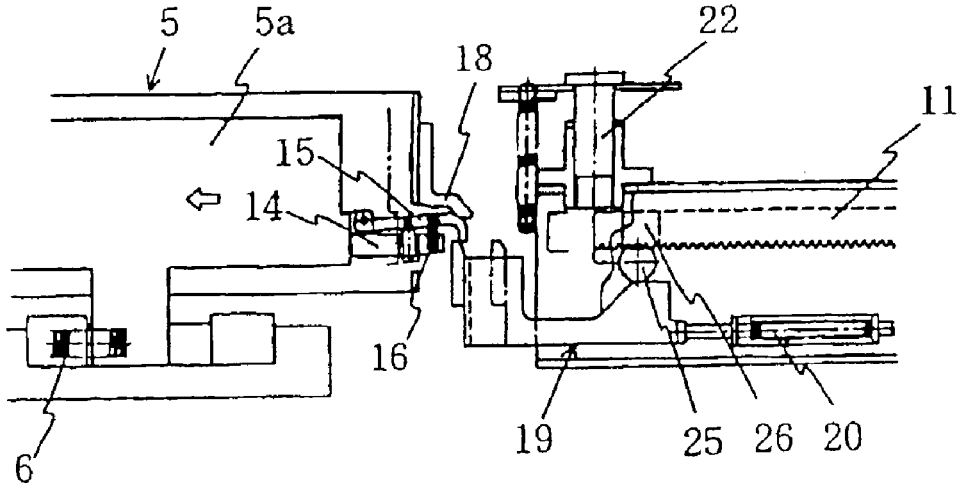
Fig. 12 Prior Art
FIG. 12 is a side view showing an unlocking action of the side sliding door apparatus shown in FIG. 9.

FIG. 8 shows a locking action, i.e. the sliding door closing action. In response to a closing instruction in the state in which the sliding door 1 is opened, the movable element 5*a* moves rightward in FIG. 8 to bring the push rod 14 into contact with the slider 19. FIG. 8 shows the locking action when the push rod 14 reaches the slider 19. As the movable element 5*a* moves further, the push rod 14 presses the slider 19 rightward to release the cam surface 19*a* from the roller 25. This causes the latch rod 22 unsupported to move downward by the urging force of the lock spring 24, so that the end thereof is brought into contact with the moving body 4. With the rightward movement of the moving body 4, the latch rod 22 falls into the latch hole 26 to lock the sliding door 1 while sliding on the upper surface of the moving body 4. As a result, the side sliding door apparatus is brought into the locked state again shown in FIG. 5. According to the second embodiment, in the locking action, the movable element 5*a* is not resisted by the spring (the back spring 20 in the first embodiment) when pressing the slider 19, and the required force and speed of the linear motor 5 are reduced as compared with the first embodiment. Accordingly, the above mentioned collision noise during the locking action is reduced, and the suction force of the magnetic solenoid 33 required for the unlocking action is reduced.

As described above, according to the present invention, the separate actuators drive the right and left sliding doors independently. Therefore, even if one actuator breaks down, the other actuator can actuate one of the two sliding doors. Further, by unlocking the sliding doors by the drive means other than the actuators, the sliding doors can be prevented from being unlocked or disabled accidentally due to a failure or a breakdown of the actuator. Therefore, the present invention greatly improves the safety and operational reliability of the side sliding door apparatus for the electric railcar.

While the invention has been explained with reference to the specific embodiments, the explanation is illustrative and the invention is limited only by the appended claims.

What is claimed is:

1. A sliding door apparatus for opening and closing an entrance of a vehicle, comprising:

a horizontal door rail disposed horizontally above the entrance of the vehicle, two sliding doors movably supported on the door rail, two actuators connected to the respective sliding doors for driving the same, two locking mechanisms installed in the respective sliding doors for locking the same when the sliding doors are closed, and two unlocking mechanisms installed in the respective sliding doors and connected to the locking mechanisms for unlocking the same independently, each unlocking mechanism being operated separately from each actuator so that each of the doors can be independently actuated by the actuator, locking mechanism and unlocking mechanism.

2. A sliding door apparatus according to claim 1, wherein each of said actuators is formed of a linear motor.

3. A sliding door apparatus according to claim 1, wherein each of said locking mechanisms includes a moving mechanism for locking the corresponding sliding door together with a closing movement of each of the sliding doors.

4. A sliding door apparatus according to claim 1, wherein each of said unlocking mechanisms includes drive means for actuating the same independently from the corresponding actuator to unlock each of the sliding doors.

5. A sliding door apparatus according to claim 1, wherein each of said locking mechanisms comprises a latch member movably supported on the vehicle, a fixing member disposed on the sliding door and engaging the latch member to lock each of the sliding doors in a closed state, and a forcing member for urging the latch member toward the corresponding sliding door.

6. A sliding door apparatus according to claim 5, wherein said latch member comprises a latch rod slidably supported on the vehicle to be inserted in a latch hole formed in the fixing member to lock the corresponding sliding door in the closed state, and said forcing member includes a spring for urging the latch rod toward the latch hole.

7. A sliding door apparatus according to claim 5, wherein each of said unlocking mechanisms comprises drive means for driving the latch member against a force of the forcing member to release the latch member from the fixing member.

8. A sliding door apparatus according to claim 7, wherein said drive means is formed of an electromagnetic solenoid.

9. A sliding door apparatus according to claim 7, further comprising release-holding means associated with the latch member for holding the latch member in a state released from the corresponding sliding door.

10. A sliding door apparatus according to claim 9, wherein said release-holding means comprises a locking member for locking the latch member in the state released from the corresponding sliding door, moving means for moving the locking member to a lock position where the latch member is to be locked when the corresponding sliding door opens, and returning means for returning the latch member from the lock position to a wait position where the latch member is to be unlocked when the corresponding sliding door closes.

11. A sliding door apparatus according to claim 10, wherein said locking member comprises a slider with a cam part slidably supported on the vehicle for preventing the latch member via the cam part from moving toward the corresponding sliding door.

12. A sliding door apparatus according to claim 11, wherein said moving means comprises a spring disposed between the slider and the vehicle.

13. A sliding door apparatus according to claim 11, wherein said moving means comprises a pulling member for sliding the slider by a predetermined distance along with the corresponding sliding door when the corresponding sliding door opens.

14. A sliding door apparatus according to claim 13, wherein said returning means comprises a pushing member for sliding the slider by the predetermined distance along with the corresponding sliding door in a direction opposite to a direction, in which the slider slides when the corresponding sliding door opens, when the corresponding sliding door closes.

15. A sliding door apparatus according to claim 1, further comprising lock-detecting means for determining whether each of the two sliding doors is locked.

16. A sliding door apparatus according to claim 1, further comprising closure detecting means for determining whether each of the two sliding doors opens or closes.

* * * * *

UNITED STATES PATENT AND TRADEMARK OFFICE

CERTIFICATE OF CORRECTION

PATENT NO. : 6,854,399 B2
DATED : February 15, 2005
INVENTOR(S) : Akio Inage

It is certified that error appears in the above-identified patent and that said Letters Patent is hereby corrected as shown below:

Column 9,
Line 47, after "closed," insert -- each locking mechanism being formed independently and separately from each actuator so that each locking mechanism locks each sliding door regardless of an operation of the actuator when a corresponding sliding door is closed, --.

Signed and Sealed this

Seventeenth Day of May, 2005

JON W. DUDAS
*Director of the United States Patent and Trademark Office*